United States Patent [19]

Templin

[11] Patent Number: 4,788,784

[45] Date of Patent: Dec. 6, 1988

[54] NOVEL DISPLAY SYSTEM AND METHOD FOR PRODUCING SAME

[76] Inventor: Robert W. Templin, 4800 North Lombard, Portland, Oreg. 97203

[21] Appl. No.: 97,611

[22] Filed: Sep. 16, 1987

[51] Int. Cl.[4] ..... G09F 3/18

[52] U.S. Cl. ..... 40/657; 211/59.1; 248/220.3

[58] Field of Search ..... 40/19.5, 594, 20 A, 40/124, 622, 489; 248/220.3, 220.4, 221.1; 434/364, 407, 427; 206/460; 211/54.1, 59.1

[56] References Cited

U.S. PATENT DOCUMENTS

| | | | |
|---|---|---|---|
| 2,914,873 | 12/1959 | Brennan | 49/594 |
| 3,263,347 | 8/1966 | McCutcheon | 248/220.3 |
| 3,483,647 | 12/1969 | Slavsky | 40/622 |
| 3,799,357 | 3/1974 | Govang | 206/806 |
| 4,005,539 | 2/1977 | Chamberlain | 40/622 |
| 4,014,118 | 3/1977 | Robinet et al. | 40/622 |
| 4,179,831 | 12/1979 | Cook | 40/19.5 |
| 4,245,414 | 1/1981 | Shypula | 40/19.5 |
| 4,378,884 | 4/1983 | Anderson | 211/59.1 |

*Primary Examiner*—Gene Mancene
*Assistant Examiner*—Cary E. Stone
*Attorney, Agent, or Firm*—Marger & Johnson

[57] ABSTRACT

This invention relates to a readily removable display sheet which, when mounted onto a perforated board, provides a novel display system for arranging and displaying salable goods to customers. The readily removable display sheet mounted to the perforated board comprises a flexible display covering substrate adapted for mounting onto the perforated board. The substrate has located therethrough a plurality of apertures arranged in a plurality of rows and columns. The size and location of the respective apertures is substantially the same as the size and location of the respective apertures in the perforated board. This facilitates the connection of display support members within the apertures and to the perforated board. The covering substrate is readily removable from the perforated board for replacement by another display sheet.

20 Claims, 1 Drawing Sheet

NOVEL DISPLAY SYSTEM AND METHOD FOR PRODUCING SAME

BACKGROUND OF THE INVENTION

This invention relates to a novel display system for expeditiously arranging and for displaying salable goods, and to a novel method for producing such a system.

There are prior art devices comprising permanent structural configurations for attaching a workpiece to a structurally fixed panel or board. For instance, interchangeable signs, such as those described in U.S. Pat. No. 4,014,118, comprise structural components, such as an outer frame, a background section, and numbers, letters, or symbols attached thereto which are replaceable or interchangeable. Signboards for peg letters are described in U.S. Pat. No. 3,483,647 which comprise two identical back-to-back waffled panels of thin sheet material, each panel having raised dimples separated by regularly-spaced horizontal and vertical grooves, each with a peg hole centered in each dimple. In U.S. Pat. No. 2,914,873, display panels are described which present an adhesive surface to which sheet-like articles may be securedly mounted thereto. Once secured, the articles may be removed, without damage, by pulling off the article from the panel. In U.S. Pat. No. 4,005,539, a Pegboard composition is described comprising a body secured to a sheet of resiliently-deformable material, with a plurality of similar apertures therethrough arranged as a regular lattice of intersecting rows and columns. An elongate pin formed of a character, and having a lateral dimension greater than the largest lateral dimension of an aperture, can be pushed through one of the apertures and be firmly gripped by a resilient deformation of at least a sheet.

"Pegboard," which is a registered trademark of Masonite, is a perforated particle board product comprising a rigid, resilient particle board material containing a plurality of apertures which, in combination with display support members capable of being securedly mounted within the apertures, can support salable goods in selected positions on the board for display purposes. These display support members can include, for example, display hooks, display arms and the like. The apertures are arranged in the Pegboard structure in a plurality of rows and columns. Attachment of salable goods onto display support members connected to conventional Pegboard material is an inexpensive and preferred way of presenting such goods to the public in a retail outlet. Unfortunately, arranging display elements onto conventional Pegboard in a neat and orderly fashion is a time-consuming process which requires a great deal of merchandising knowledge in order to properly present the goods to customers.

Therefore, a need exists for a display system in which salable goods can be presented to the public in an appealing, eye-catching manner, without requiring substantial skill and a substantial amount of set-up time for arranging such a display.

SUMMARY OF THE INVENTION

This invention relates to a readily removable display sheet which, when mounted onto a perforated board, provides a novel display system for arranging and displaying salable goods to customers. The display system of this invention can be arranged without requiring substantial skill and without requiring a substantial amount of set-up time. However, when the subject display system is employed, the vendor's salable goods can be presented to customers in an appealing, informative and eye-catching manner.

The perforated board of the display system of the present invention includes a plurality of apertures located therethrough which are arranged in a plurality of rows and columns. The readily removable display sheet mounted to the perforated board comprises a flexible display covering substrate adapted for mounting onto the perforated board. The substrate has located therethrough a plurality of apertures arranged in a plurality of rows and columns. The size and location of the respective apertures is substantially the same as the size and location of the respective apertures in the perforated board. This facilitates the connection of display support members within the apertures and to the perforated board. The covering substrate is readily removable from the perforated board for replacement by another display sheet.

An adhesive composition is disposed on a first surface of the covering substrate for securedly adhering the covering substrate to the perforated board. The adhesive is capable of permitting the covering substrate to be readily removed from engagement with the perforated board without causing substantial damage to the board.

Finally, a backing sheet is removably attached to the covering substrate by the adhesive composition for protecting the adhereability of the covering substrate for mounting onto the perforated board. Preferably, the adhesive composition comprises a pressure-sensitive adhesive.

The display covering substrate preferably includes display indicia disposed thereon. The display indicia can comprise descriptive indicia and pictorial indicia as hereinafter described. Furthermore, the backing sheet preferably comprises a main section and an alignment section, respectively. The alignment section is separately removable to expose only the portion of the adhesive surface which it covers. Therefore, the covering substrate and the perforated board can be properly aligned by initially adhering only the exposed adhesive surface of the covering sheet to its corresponding portion of the perforated board.

The foregoing and other objectives, features and advantages of the invention will become more readily apparent from the following detailed description of the preferred embodiment which proceeds with reference to the drawings.

DETAILED DESCRIPTION OF A PREFERRED EMBODIMENT

Figure 1:
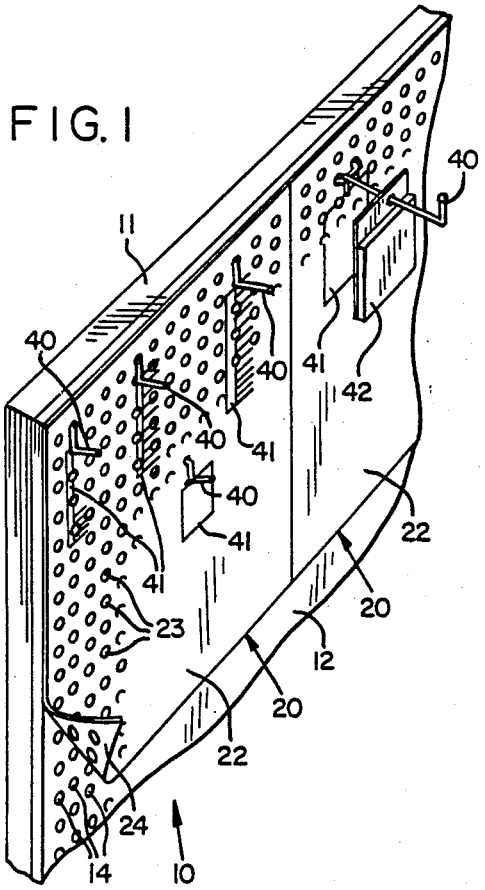
FIG. 1 is an enlarged fragmentary perspective view of a novel display system of the present invention attached to a vertical display support frame.

Referring now to FIGS. 1–4, a novel display system 10 is depicted comprising an easily replaceable display sheet 20 adhered to a perforated board 12 by adhesive composition 24.

The display system 10 is attached to a vertically-disposed display support frame 11 for use, for example, in a retail outlet for presentation of salable goods 42 to customers. Display support frame 11 comprises a frame structure capable of supporting display system 10 in a vertical position. Display support frame 11 can be fabricated of various structural materials of construction capable of vertically supporting display system 10. However, display frame 11 is typically made of wood, a composite wood product, metal or plastic.

Display system 10 includes a rigid, durable, perforated board 12 having a plurality of apertures 14 located therethrough which are arranged in a plurality of rows and columns. The rows and columns of apertures 14 are substantially parallel to each other. The typical materials of construction for the rigid board 12 are wood, wood composite boards, or wood fiber composite boards, such as hardboard, particle board, flakeboard, and the like, in which the above-described apertures 14 are perforated therewithin. The nature and properties of basic hardboard, for example, are described in publication ANSI/AHA A135.4—1982 of the American Hardboard Association.

A typical perforated board, such as Pegboard, has horizontal rows of apertures spaced apart at a vertical distance measured from the respective center of the respective apertures in adjacent rows of about one inch. Similarly, the vertical columns of apertures are generally spaced apart at a horizontal distance measured from the respective centers of the respective apertures in adjacent columns of about one inch. All the apertures in the perforated board 12 are substantially the same diameter, generally from about ⅛ inch up to about ¼ inch. In any case, the perforated board is rigid and durable in nature being fabricated to withstand the wear and tear associated with long-term continued use, and for continuing engagement and disengagement of display support members 40 into and out of apertures 14.

The perforated board 12 is attached to the display support frame 11 by conventional attachment means such as nails, screws, nut and bolt assemblies and the like. If the frame 11 is constructed of metal or plastic, board 12 can be attached thereto by pop-riveting or other known attachment techniques.

A readily removable display sheet 20 can be temporarily joined to perforated board 12 for use in facilitating the presentation and display of salable goods 42 to customers. The display sheet 20 comprises a covering substrate 22 which is temporarily mountable onto perforated board 12 by attachment to a first surface 25 of the substrate 22. Substrate 22 includes a plurality of apertures 23 located therethrough which are arranged in a plurality of rows and columns. The size and location of the respective apertures 23 are coextensive and substantially conform to the size and location of the respective apertures 14 in the pegboard 12. In this way, the connector elements of the display support members 40 during use will pass within apertures 14 and 23, respectively, and be anchored to the board 12.

The display support members 40 can comprise, for instance, various styles and configurations of display support hooks or display support arms capable of supporting salable goods 42 for displaying same to customers. These display support members typically include a connector section which will pass within a pair of adjacent apertures 23 and then be locked in position therewithin. In this way, the display support members 40 are anchored in place within board 12. The display support members 40 also include a support hook section, including a pair of curved connector fingers, or including a support arm section, on which the salable goods 42 are supported in place for displaying purposes, but which permit easy removal of the goods therefrom on purchase by a customer.

Covering substrate 22 is fabricated of a flexible, resilient material having sufficient strength properties to remain intact when a plurality of apertures 23 are located therewithin and to withstand the rigors of day-to-day use in the display operations, and which can receive display indicia 41 which are disposed thereon. Typical materials employed as covering substrate 22 include polymeric materials including plastic, thermoplastic and rubber compositions, as well as paper products including uncoated and coated paper compositions.

Display indicia 41 can be disposed on a second surface 27, preferably including descriptive and pictorial indicia. It can be directed to descriptive information such as printed indicia affixed to covering substrate 22. This printed indicia can include product layouts such as schematics and the like describing the relative location of salable goods 42 on display system 10, product descriptions including the name and/or picture of salable goods 42, and product numbers including any number designated for salable goods 42. It can also be directed to pictorial information, such as designs and colored decorative matters, or anything affecting the look of a display. Another group could include any form of advertising, both descriptive and/or pictorial in form. This type of information can be located between the salable goods 42. Other types of uses could include "scratch and sniff" technology for cosmetics, perfumes, and the like, or even a mirrored look to increase depth perception of the display.

Covering substrate 22 is securedly adhered to perforated board 12 so that apertures 14 and 23 are aligned with each other and are held in position by an adhesive composition 24 located on a first surface of covering substrate 22. Typically an adhesive composition which comprises a pressure-sensitive adhesive will be employed for this purpose. Adhesive composition 24 is designed so that it immediately adheres covering substrate 22 to perforated board 12 by merely pressing covering substrate 22 against perforated board 12 and can remain in a fixed position against board 12 during display use. Covering substrate 22, once mounted to substrate 22, may be removed, from perforated board 12, without damaging board 12 by pulling off the covering substrate 22. A pressure-sensitive adhesive is an adhesive capable of adhering substrate 22 in position against perforated board 12 for a substantial period of time but which permits covering substrate 22 to be removed from the board 12 without substantially damaging the board. An example of pressure-sensitive adhesives useful herein are Scotch-Grip Industrial Adhesives manufactured by 3M, such as Scotch-Grip 4268-NF and Scotch-Grip 4910-NF. Scotch-Grip 4268-NF is an acrylate water-based adhesive having a 48% total solids and a net weight of 8.4 pounds per gallon. Scotch-Grip 4910-NF is a synthetic rubber dissolved in a 1,1,1-trichloroethane solvent, having a total solids of 25% and a net weight of 10 pounds per gallon.

Figure 2:
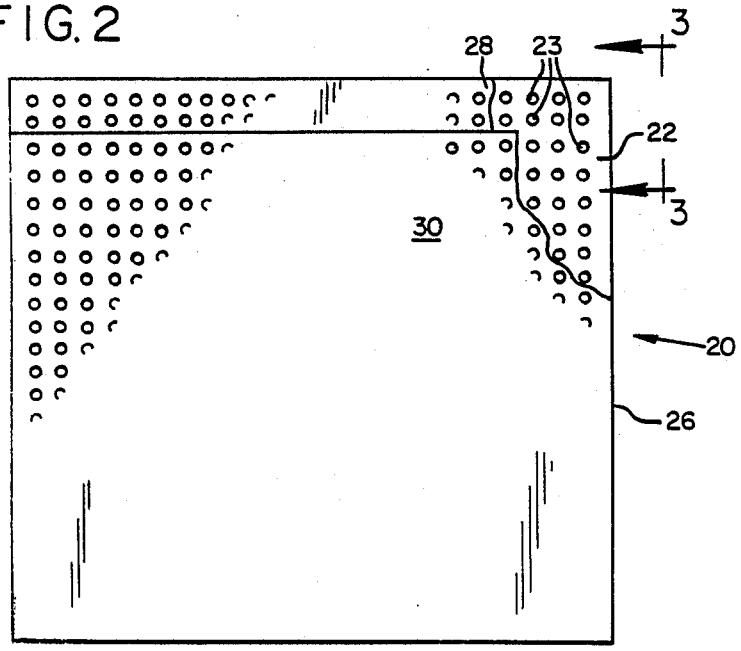
FIG. 2 is a front elevational, partially sectional view of an easily replaceable display sheet of the present invention.
Figure 3:
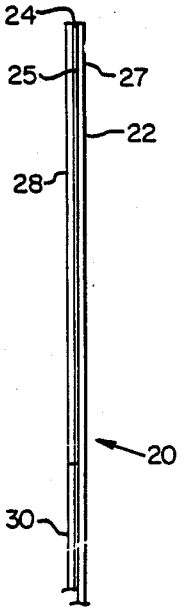
FIG. 3 is an enlarged, fragmentary end view taken along line 3—3 of the display sheet of FIG. 2.

As depicted more specifically in FIGS. 2 and 3, in order to protect the adhereability of display sheet 20 onto perforated board 12 prior to use, a removable backing sheet 26 is adhered to the adhesive composition 24 disposed on the first surface of the covering sheet 22. Backing sheet 26 is a thin film sheet which will adhere to adhesive composition 24 and protect the adhesive composition from being dissipated without substantially reducing its ability to adhere cover sheet covering substrate 22 to perforated board 12. Examples of such removable backing sheets include polymeric film sheets, such as polyethylene film sheets and the like, and highly smoothed paper sheets, such as glassine paper and the like.

Figure 4:
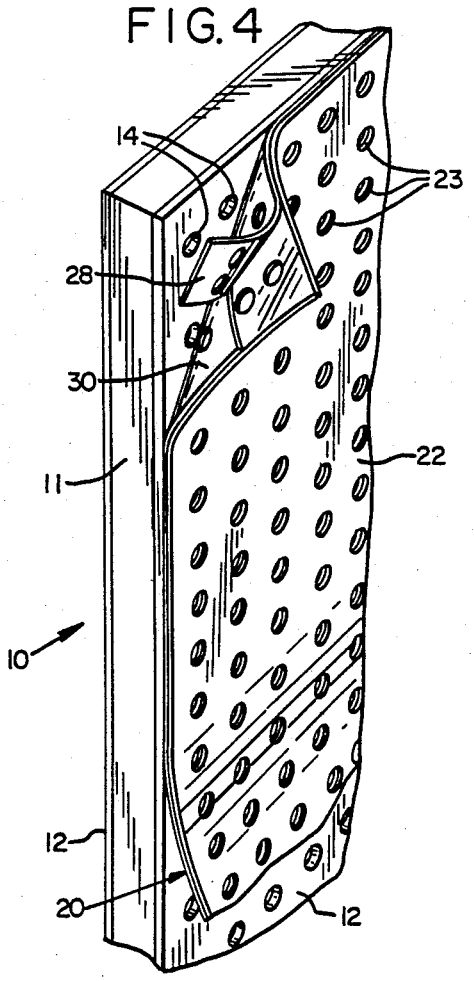
FIG. 4 is an enlarged fragmentary perspective view of a pair of perforated boards attached to a vertical display support frame, with the display sheet of FIG. 2 about to be mounted to one of the perforated boards.

In order to facilitate the proper adhesion and positioning of covering substrate 22 for mounting onto perforated board 12, as more particularly shown in FIG. 4, the backing sheet comprises a main section 30 and, at the top of said backing sheet, an alignment section 28. By removing only the alignment section 28, only that section of the adhesive surface is exposed and aligning the apertures 14 and 23 in the respective perforated board and covering substrates need only be done for the top row or two of the backing sheet 26. Then, once in place, the main section 30 of the backing sheet 26 can be removed and mounting of the remainder of the covering substrate 22 can be facilitated onto perforated board 12.

More specifically, a new display sheet 20 replaces an old display sheet previously mounted onto board 12 as follows: All salable goods 42 and display support members 40 are removed from the display system 10. The old display sheet 20 is then removed so that all that remains is perforated board 12. The new display sheet 20 is mounted onto perforated board 12 as described above. The display members 40 are then positioned within new display sheet 20 of new display system 10 and the requisite salable goods 42 are hung onto the properly positioned display members.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

I claim:

1. A readily removable display sheet for use with a perforated board for arranging and displaying salable goods to customers, which comprises:

a flexible display covering substrate adapted for mounting onto said perforated board and having located therethrough a plurality of apertures arranged in a plurality of rows and columns, the size and location of the respective apertures being substantially the same as the size and location of the respective apertures in said perforated board, for facilitating the connection within said apertures and to said perforated board of display support members, said covering substrate being readily removable from said perforated board for replacement by another display sheet;

an adhesive composition, disposed on a first surface of said covering substrate, for securedly adhering said covering substrate to said perforated board, said adhesive being capable of permitting said covering substrate to be readily removed from engagement with said perforated board without causing substantial damage to said board; and a backing sheet, removably attached to said covering sheet by said adhesive composition, for protecting the adhereability of said covering sheet for subsequent mounting onto said perforated board.

2. The display sheet of claim 1, wherein said display covering substrate includes display indicia disposed thereon.

3. The display sheet of claim 2, wherein said display indicia comprises descriptive indicia.

4. The display sheet of claim 2, wherein said display indicia comprises pictorial indicia.

5. The display sheet of claim 1, wherein said adhesive composition comprises a pressure-sensitive adhesive.

6. The display sheet of claim 1, wherein said backing sheet comprises a main section and an alignment section, respectively, said alignment section being separately removable to expose only the portion of the adhesive surface covered by said alignment section for initially adhering in proper alignment only the exposed adhesive surface of said covering sheet to said perforated board.

7. A novel display system which comprises:

a perforated board composition having a plurality of apertures located therethrough and arranged in a plurality of rows and columns;

a flexible display covering substrate mounted onto said perforated board and having located therethrough a plurality of apertures arranged in a plurality of rows and columns, the size and location of the respective apertures being substantially the same as the size and location of the respective apertures in said perforated board, for facilitating the connection within said apertures and to said perforated board of display support members, said covering substrate being readily removable from said perforated board for replacement by another display sheet; and an adhesive composition, disposed on a first surface of said covering substrate, securedly adhering said covering substrate to said perforated board, said adhesive being capable of permitting said covering substrate to be readily removed from engagement with said perforated board without causing substantial damage to said board.

8. The display sheet of claim 7, wherein said display covering substrate includes display indicia disposed thereon.

9. The display sheet of claim 8, wherein said display indicia comprises descriptive indicia.

10. The display sheet of claim 8, wherein said display indicia comprises pictorial indicia.

11. The display sheet of claim 7, wherein said adhesive composition comprises a pressure-sensitive adhesive.

12. A method for producing a novel display system, which comprises:

providing a perforated board having a plurality of apertures located therethrough and arranged in a plurality of rows and columns;

providing a readily removable display sheet for use with said perforated board, said display sheet comprising a flexible covering substrate having located therethrough a plurality of apertures arranged in a plurality of rows and columns, the size and location of the respective apertures being substantially the same as the size and location of the respective apertures in said perforated board, said covering substrate having an adhesive composition on one side capable of securedly adhering said covering substrate to said perforated board, but being readily removed from said substrate for replacement by another covering sheet; and mounting said flexible covering onto said perforated board so that the respective apertures in said perforated board are in substantial alignment with the respective apertures in said covering substrate.

13. The method of claim 12, which further includes the step of providing display indicia on said display covering substrate.

14. The method of claim 13, wherein said display indicia comprises descriptive indicia.

15. The method of claim 14, which further includes the step of positioning display members within said respective apertures in said substrate and within said respective apertures in said board so that said display members are locked in position therewithin.

16. A method for forming a novel display sheet, which comprises:

providing a flexible covering substrate adapted for mounting onto a perforated board having a plurality of apertures located therethrough which are arranged in a plurality of rows and columns;

locating a plurality of apertures within said covering substrate which are arranged in a plurality of rows and columns, the size and location of the respective apertures in said substrate being substantially the same as the size and location of the respective apertures in said perforated board; and coating one side of said covering substrate with an adhesive composition capable of securedly adhering said covering substrate to said perforated board, but which is readily removed from said substrate for replacement by another display sheet.

17. The method of claim 16, which further includes the step of providing display indicia on said display covering substrate.

18. The method of claim 17, wherein said display indicia comprises descriptive indicia.

19. The method of claim 17, wherein said display indicia comprises pictorial indicia.

20. The display sheet of claim 16, wherein said adhesive composition comprises a pressure-sensitive adhesive.

* * * * *